US005177971A

United States Patent [19]

Kiyota

[11] Patent Number: 5,177,971

[45] Date of Patent: Jan. 12, 1993

[54] REFRIGERATOR

[75] Inventor: Hiroyuki Kiyota, Kamakura, Japan

[73] Assignee: Mitsubishi Denki Kabushiki Kaisha, Japan

[21] Appl. No.: 905,779

[22] Filed: Jun. 29, 1992

[30] Foreign Application Priority Data

Jul. 1, 1991 [JP] Japan ..... 2-160334

[51] Int. Cl.[5] ..... F25B 9/00

[52] U.S. Cl. ..... 62/6; 60/520

[58] Field of Search ..... 62/6; 60/520; 318/126, 318/128, 130, 134, 375, 379, 380

[56] References Cited

U.S. PATENT DOCUMENTS

| | | | |
|---|---|---|---|
| 3,991,585 | 11/1976 | Mulder | 62/6 |
| 4,811,563 | 3/1989 | Furuishi et al. | 60/520 |
| 4,822,390 | 4/1989 | Kazumoto et al. | 62/6 |
| 4,872,313 | 10/1989 | Kazumoto et al. | 62/6 |
| 5,088,288 | 2/1992 | Katagishi et al. | 62/6 |

FOREIGN PATENT DOCUMENTS

| | | |
|---|---|---|
| 63-148056 | 6/1988 | Japan . |
| 3-36470 | 2/1991 | Japan . |

*Primary Examiner*—Harry B. Tanner

*Attorney, Agent, or Firm*—Wolf, Greenfield & Sacks

[57] ABSTRACT

A refrigerator comprising: a movable coil which is formed by winding a conductor on a cylindrical bobbin, and which, when a.c. current flows therethrough, reciprocates in a magnetic field produced by a magnetic circuit; a piston operatively coupled to the movable coil to reciprocate in a cylinder; a compression space, the volume of which is varied by the reciprocation of the piston; a cold cylinder; a displacer which divides the inside of the cold cylinder into a cold space and a hot space, and which reciprocates in the cold cylinder; a regenerator arranged in the displacer; and a changeover mechanism for short-circuitting the conductor wound to form the movable coil when the refrigerator is not in use.

1 Claim, 3 Drawing Sheets

REFRIGERATOR

The present invention relates to Stirling refrigerators which cool e.g. an infrared sensor at temperatures as extremely low as e.g. 77K.

Referring now to FIG. 3, there is shown the typical structure of a conventional Stirling refrigerator. The Stirling refrigerator is mainly constituted by a compressor 1, a cold finger 2, a connecting pipe 3 for connecting the compressor 1 and the cold finger 2, and a power source 29 for supplying electrical current to the compressor 1. The compressor 1 includes a cylinder 4, and a piston 5 which reciprocates in the cylinder 4, sliding on the inner surface of the cylinder 4. The piston 5 is mounted on one end of a supporting coil 6 15 which extends from an inner wall of a housing 10. The piston 5 has a movable coil 8 coupled thereto, and the movable coil 8 is formed by winding a conductor 9 on a cylindrical bobbin 7 of non-magnetic material. The conductor 9 which form the movable coil 8 has opposite ends connected to a pair of lead wires 11. The lead wires 11 have a pair of electrical terminals 12 which are mounted on the housing 10. The electrical terminals 12 are electrically connected to the power source 29, and the power source 29 supplies the movable coil 8 with sinusoidal a.c. current. In the housing 10 is arranged a permanent magnet 13 and a yoke 14, which forms a magnetic circuit 15. The movable coil 8 is constructed so that it can reciprocates in an axial direction of the piston 5 in a gap 16 formed in the magnetic circuit 15. In the gap 16 is produced a permanent magnetic field in a radial direction transverse to the moving direction of the movable coil 8. In the entire inside of the compressor 1 is sealed a working gas, such as a helium gas, having a high pressure. The inner space which is located above the piston in the cylinder 4 is called a compression space which is indicated by reference numeral 17. In order that the working gas in the compression space 17 is difficult to pas through a gap between the cylinder 4 and the piston 5, the gap between the cylinder 4 and the piston 5 is formed as narrowly as possible.

On the other hand, the cold finger 2 includes an elongated cold cylinder 18, and a displacer 20 which reciprocates in the cold cylinder 18 while sliding on the inner surface of a sleeve 27 arranged in a lower portion of the cold cylinder 18. The displacer 20 is supported by a resonant spring 19. The inside space of the cold cylinder 18 is divided into two parts by the displacer 20. The upper part above the displacer 20 is called a cold space which is denoted by reference numeral 21, and the lower part is called a hot space which is denoted by reference numeral 22. In the displacer 20 is arranged a regenerator 23 and gas passage holes 24. The cold space 21 and the hot space 22 communicate with the regenerator 23 through the gas passage holes 24. The regenerator 23 is filled with a regenerator matrix 25 such as a copper wire mesh screen. In order to prevent the working gas from passing through a gap between the sleeve 27 and the displacer 20, the gap between the displacer 20 and the sleeve 27 is formed as narrowly as possible. The respective spaces of the cold finger 2 are filled with the working gas, such as the helium gas, having a high pressure like the compressor 1. The compression space 17 of the compressor 1 and the hot space 22 of the cold finger 2 communicate with each other through the connecting pipe 3. The compression chamber 17, the space in the connecting pipe 3, the cold space 21, the hot space 22, the regenerator 23 and the gas passage holes 24 communicate with each other, and these spaces are called, as the whole, a working space, which is denoted by reference numeral 26.

The operation of the conventional refrigerator constructed as stated earlier will be explained. When a.c. current is applied to the conductor 9 of the movable coil 8 from the power source 29 through the electric terminals 12 and the lead wires 11, the conductor 9 is subjected to a Lorentz force in an axial direction due to the interaction of the permanent magnetic field in the gap 16 and the current flowing through the conductor 9. As a result, the piston 5 which is coupled to the movable coil 8 is caused to reciprocate in the cylinder 4, thereby giving a sinusoidal undulation to the gas pressure in the working space 26 which extends from the compression space 17 to the cold space 21. Such a pressure undulation causes the working gas to move to and fro in the regenerator 23. At that time, fluid resistance is created in the regenerator 23 to vertically apply a force to the displacer 20 with the regenerator 23 in it. The interaction of the force and the resonant spring 19 causes the displacer 20 to reciprocate in the cold finger 2 in its axial direction at the same frequency as the piston 5 and out of phase with the piston 5. When the piston 5 and the displacer 20 are moving while keeping a suitable difference in phase, cold production generates according to the principle which will be described below.

When the displacer 20 is located at an upper portion in the cold finger 2, the piston 5 moves upward to compress the entire of the working gas in the working space 26. The working gas in the compression space 17 flows into the hot space 22 through the connecting pipe 3, while compression heat which generates on compression is given off to ambient air through the housing 10, the connecting pipe 3 or the like. Next, the displacer 20 moves downward, causing the working gas in the hot space 22 to move to the cold space 21 through the regenerator 23 and the gas passage holes 24. At that time, the regenerator 23 precools the working gas by the cold production which has been accumulated in the preceding half cycle. Then, the piston 5 moves downward to expand the entire working gas in the working space 26. The working gas expands in the cold space 21 as well to generate cold production in the cold space 21. After that, the displacer 20 moves upward, causing the working gas in the cold space 21 to move to the hot space 22 through the regenerator 23 and the gas passage holes 24. At that time, the regenerator 23 is precooled by the working gas. Further, the piston 5 moves upward again to start compressing the working gas, and the above-described cycle is repeated. Since the compression and the expansion of the working gas are carried out while receiving work from the piston 5 in the former process and giving work to the piston 5 in the latter process, the working gas gives off heat on compression, and take up heat from outside on expansion. When the displacer 20 is located at the upper portion in the cold finger 2 as stated earlier, i.e. when the volume of the cold space 21 has grown small, the compression of the working gas occurs. Conversely, when the displacer 20 is located at the lower portion in the cold finger 2, i.e. when the volume of the cold space 21 has grown great, the expansion of the working gas occurs. This means that the cold space 21 is mainly subjected to expansion in terms of the entire one cycle. Heat is extracted from an outer surface of the leading portion of the cold finger to cool an object to be cooled.

Such a conventional device involves a problem which will be described. In the compressor 1, the assembly which is constituted by the piston 5 and the movable coil 8 is supported by only the supporting spring 6. This means that when vibration is given to the compressor 1 from outside, the assembly of the piston 5 and the movable coil 8 resonates to the outside vibration to vibrate in the axial direction. When the outside vibration is great, the amplitude of the assembly of the piston 5 and the movable coil 8 grows great to such an extent that the assembly collides with the cylinder 5, the housing 10 or the yoke 14. At the worst, such collision could damage the parts. The outside vibration which is enough to damage the parts is likely to occur when the refrigerator is not in use, such as a case wherein the refrigerator which has been loaded on e.g. a vehicle which carries it and a case wherein the refrigerator which has been in an artificial satellite that is launched. This means that the conventional device creates a problem in that some damage-prevention measures should be taken when the refrigerator is not in use.

It is an object of the present invention to solve the problem, and to provide a refrigerator capable of preventing a piston and movable coil assembly from vibrating at a great level and preventing parts from being damaged even if great vibration is given from outside when the refrigerator is not in use.

The foregoing and other objects of the present invention have been attained by providing a refrigerator comprising a movable coil which is formed by winding a conductor on a cylindrical bobbin, and which, when a.c. current flows therethrough, reciprocates in a magnetic field produced by a magnetic circuit; a piston operatively coupled to the movable coil to reciprocate in a cylinder; a compression space, the volume of which is varied by the reciprocation of the piston; a cold cylinder; a displacer which divides the inside of the cold cylinder into a cold space and a hot space, and which reciprocates in the cold cylinder; a regenerator arranged in the displacer; and a changeover mechanism for short-circuiting the conductor wound to form the movable coil when the refrigerator is not in use.

In accordance with the present invention, the conductor which is wound to form the movable coil can be short-circuiting by the changeover mechanism when the refrigerator is not in use. By this short-circuit connection, current which is induced by a magnetic field flows through the conductor of the movable coil when the movable coil is moving in the magnetic field. The induced current generates a Lorentz force in such a direction that the movable coil is prevented from moving. As a result, even if a great deal of vibration is given from outside to the refrigerator, and the piston and movable coil assembly tries to vibrate, the amplitude of the piston and movable coil assembly can be minimized, preventing parts from being damaged.

As explained, the arrangement of the present invention wherein there is provided the changeover mechanism which can short-circuit the conductor of the movable coil when the refrigerator is not in use offers an advantage in that even if a great deal of vibration is given from outside, the vibration of the piston and movable coil assembly can be minimized to prevent parts from being damaged due to collision between each other in the refrigerator when the refrigerator is not in use, such as a case wherein the refrigerator which has been loaded on e.g. a vehicle which carries it, and a case wherein the refrigerator which has been mounted in an artificial satellite that is launched.

Now, the present invention will be described in detail with reference to preferred embodiments illustrated in the accompanying drawings.

EMBODIMENT 1

Figure 1:
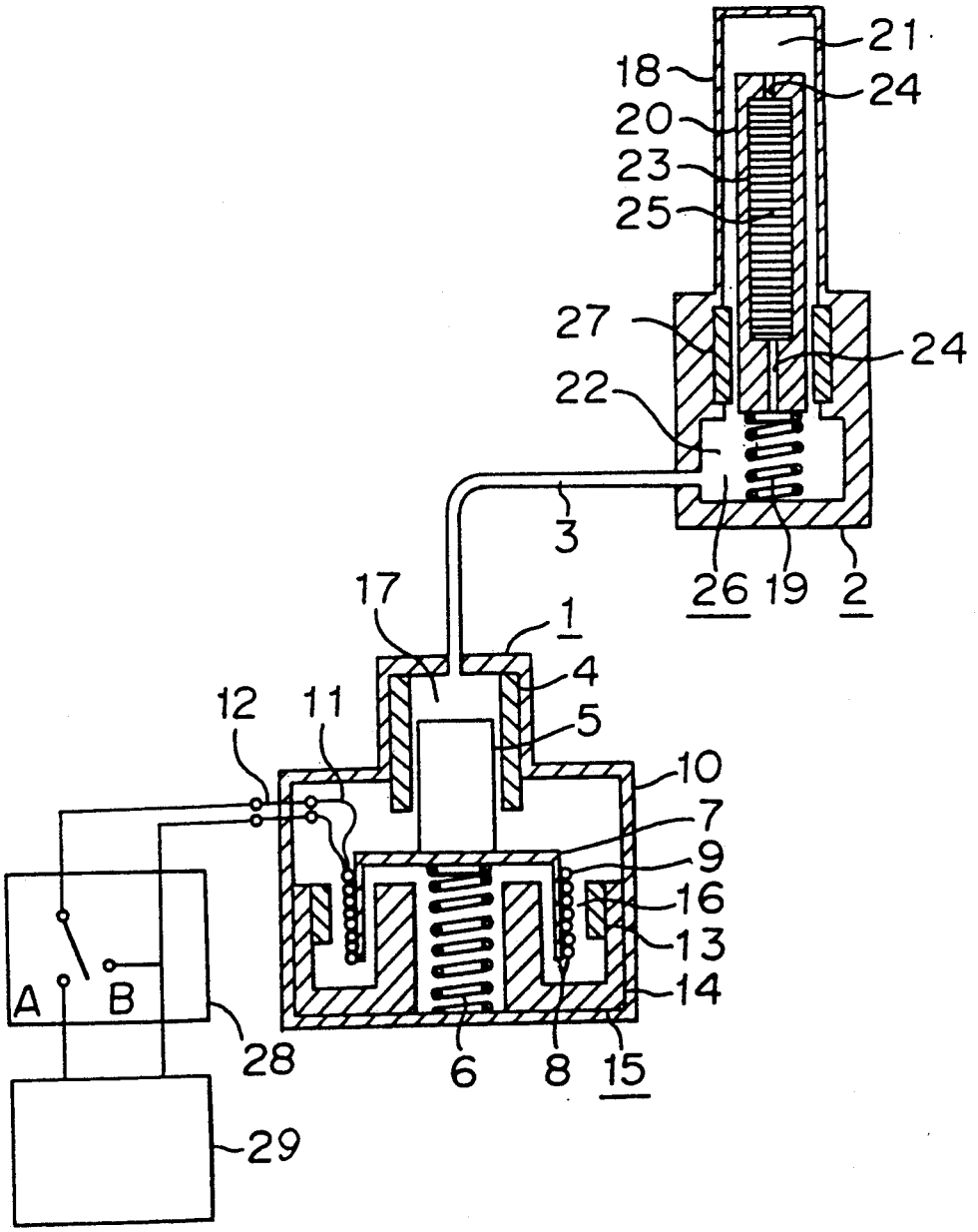
FIG. 1 is a cross sectional view showing the refrigerator according to an embodiment of the present invention.

Referring now to FIG. 1, there is shown the refrigerator according to an embodiment of the present invention. In FIG. 1, the refrigerator according to the embodiment has totally the same structure as or a similar structure to the conventional device in terms of a compressor 1, a cold finger 2, a connecting pipe 3 and a power source 29. The refrigerator of the embodiment is different from the conventional device in that a changeover mechanism 28 which can short-circuit a conductor 9 forming a movable coil 8 when the refrigerator is not in use is arranged between electrical terminals 12 and the power source 29.

Figure 3:
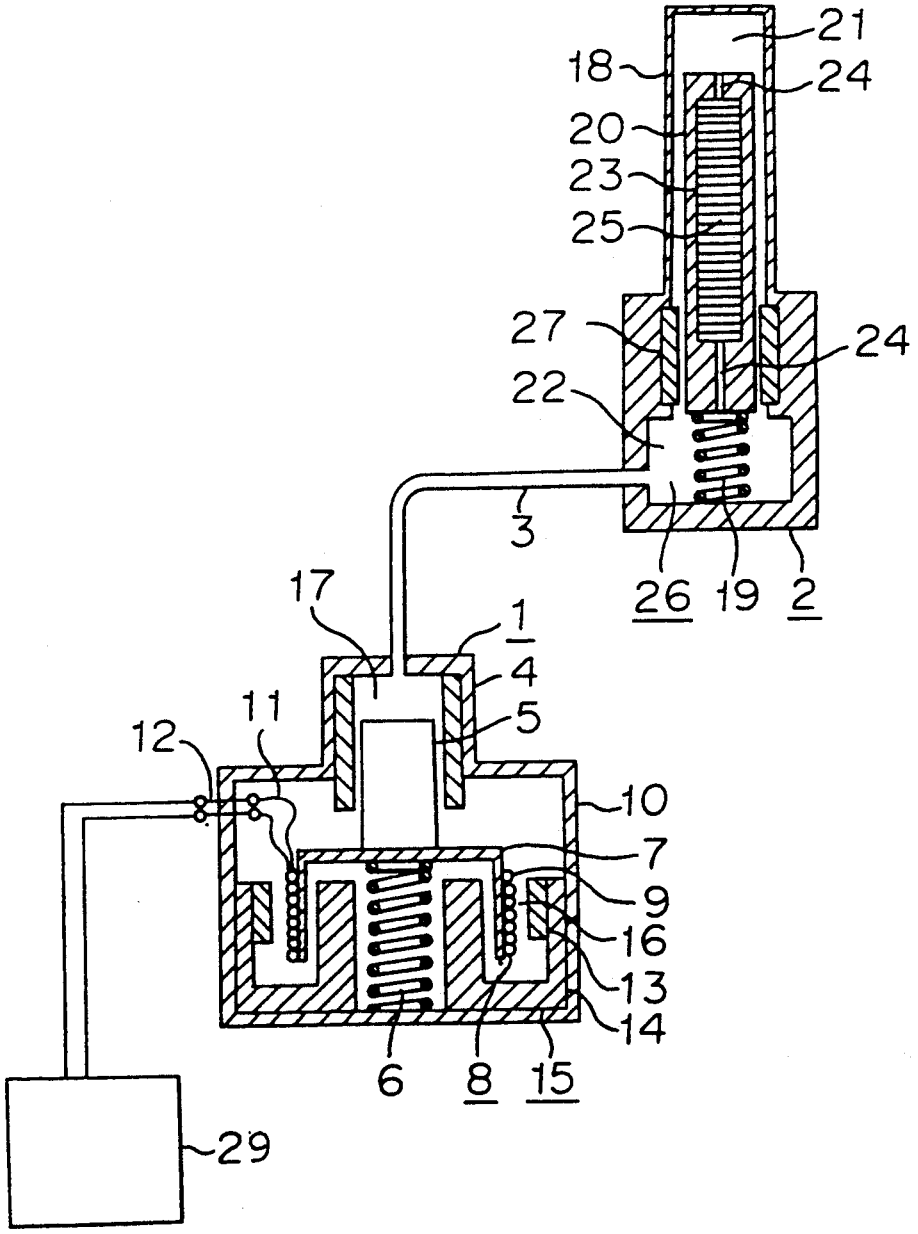
FIG. 3 is a cross sectional view showing a conventional refrigerator.

The operation of the first embodiment will be described. When the refrigerator is in use, the changeover mechanism 28 is switched to a contact A. At this state, the refrigerator generates cold production like the conventional device of FIG. 3. In accordance with the embodiment, when the changeover mechanism 28 is switched to a contact B in a case wherein the refrigerator is not in use, the conductor 9 which is wound to form the movable coil 8 can be short-circuited. By this short-circuit connection of the conductor 9, when the movable coil 8 is moving through a permanent magnetic field in a gap 16, current is induced by the magnetic field to flow through the conductor 9, and a Lorentz force generates in such a direction that the movable coil 8 is prevented from moving. As a result, even if a great deal of vibration is given to the refrigerator during e.g. transportation, the amplitude of a assembly which is constituted by a piston 5 and the movable coil 8 can be minimized, thereby preventing parts from being damaged due to collision between each other in the refrigerator.

EMBODIMENT 2

Figure 2:
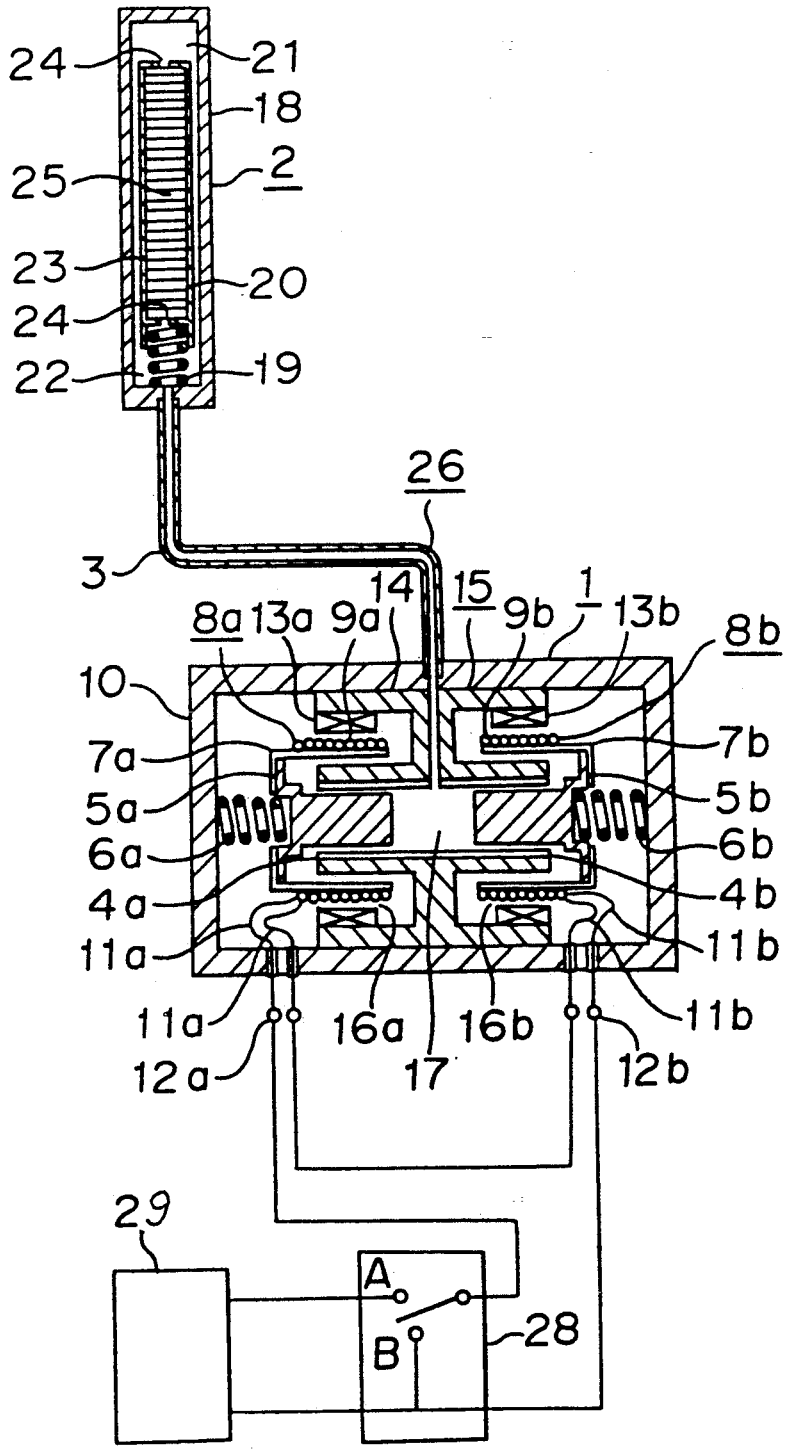
FIG. 2 is a cross sectional view showing the refrigerator according to another embodiment of the present invention.

Referring now to FIG. 2, there is shown another embodiment of the present invention. In FIG. 2, there is shown a case wherein the present invention is applied to a refrigerator having a compressor 1 with two opposite cylinders. In the embodiment shown in FIG. 2, two cylinders 4*a* and 4*b*, two pistons 5*a* and 5*b*, two supporting springs 6*a* and 6*b*, two bobbins 7*a* and 7*b*, two movable coils 8*a* and 8*b*, two conductors 9*a* and 9*b*, and other couples are arranged in symmetrical situations in order to overwhelm vibration due to reciprocation of the pistons etc. The basic principle, according to which refrigeration generates, is the same as the conventional device shown in FIG. 3. The conductors 9*a* and 9*b* which form the movable coils 8*a* and 8*b* are connected in series with each other, and have electric current supplied from a single power source 29. A changeover mechanism 28 is arranged between electrical terminals 12*a* and 12*b*, and the power source 29. When the refrigerator is in use, the changeover mechanism 28 is switched to make a connection with a contact A. When the refrigerator is not in use, the changeover mechanism 28 is switched to make a connection with a contact B, and the conductors 9*a* and 9*b* of the movable coils 8*a* and 8*b* which are connected in series are short-circuited as if they are a single coil. Such an arrangement can offer an advantage similar to the embodiment of FIG. 1. When a great deal of vibration is given from outside in a case wherein the refrigerator is not in use, an assembly of the pistons 5*a* and 5*b* and the movable coils 8*a* and 8*b* is restrained from resonating.

Although in the embodiment of FIG. 2 there is shown a case wherein the short-circuit is made while the conductors 9*a* and 9*b* of the movable coils 8*a* and 8*b* are connected in series, the present invention is applicable to a case wherein the conductors 9*a* and 9*b* are electrically separated and are short-circuited, independently.

Although in the embodiments of FIGS. 1 and 2 there is shown a case wherein the switch type device is utilized as the changeover mechanism 28, a relay type device or a semiconductor element such as a transistor can be used.

I claim:

1. A refrigerator comprising:

a movable coil which is formed by winding a conductor on a cylindrical bobbin, and which, when a.c. current flows therethrough, reciprocates in a magnetic field produced by a magnetic circuit;

a piston operatively coupled to the movable coil to reciprocate in a cylinder;

a compression space, the volume of which is varied by the reciprocation of the piston;

a cold cylinder;

a displacer which divides the inside of the cold cylinder into a cold space and a hot space, and which reciprocates in the cold cylinder;

a regenerator arranged in the displacer; and a changeover mechanism for short circuitting the conductor wound to form the movable coil when the refrigerator is not in use.

* * * * *